US005618009A

United States Patent [19]

Foster et al.

[11] Patent Number: 5,618,009

[45] Date of Patent: Apr. 8, 1997

[54] ADJUSTABLE YARN GUIDE ROLLER ELBOW

[75] Inventors: Don C. Foster; Joel D. Norris; Christopher D. Norris, all of Burlington; Ross M. Stainback, Elon College, all of N.C.

[73] Assignee: Eldon Specialties, Inc., Graham, N.C.

[21] Appl. No.: 544,879

[22] Filed: Oct. 18, 1995

[51] Int. Cl.[6] ..... B65H 57/14; B65H 57/00; G03B 1/56

[52] U.S. Cl. ..... 242/615.2; 226/91; 226/97; 226/168; 242/615.3; 242/157 R

[58] Field of Search ..... 242/157 R, 615.1, 242/615.2, 615.3; 226/168, 190, 199, 91, 97

[56] References Cited

U.S. PATENT DOCUMENTS

| | | | |
|---|---|---|---|
| 2,728,534 | 12/1955 | Wallace | 242/157 R |
| 3,834,600 | 9/1974 | Benchemoul | 242/157 R X |
| 4,027,815 | 6/1977 | Young | 242/157 R X |
| 4,164,331 | 8/1979 | Henrich . | |
| 4,194,350 | 3/1980 | Schellenberg et al. . | |
| 4,403,754 | 9/1983 | McBride, Jr. . | |
| 4,445,355 | 5/1984 | Budzich et al. . | |
| 4,748,927 | 6/1988 | Bujacich | 242/157 R X |

FOREIGN PATENT DOCUMENTS

| | | |
|---|---|---|
| 729702 | 5/1955 | United Kingdom . |

OTHER PUBLICATIONS

Ceramic Yarn Guide Best 260; 1994; p. 19; Yarn Guide of Yuasa.

*Primary Examiner*—Michael Mansen

[57] ABSTRACT

A yarn guide elbow for directing a yarn or filament in a textile process, such as a texturing process. The yarn guide elbow includes a housing, the housing defining a cavity. The housing is provided with a first opening and a second opening, each of which communicate with the cavity. A roller is disposed within the cavity and mounted on the housing for rotation. Each of the first and second openings are disposed substantially adjacent the periphery of the roller. The housing is arranged and configured such that the distance between the first and second openings may be selectively adjusted.

23 Claims, 4 Drawing Sheets

ADJUSTABLE YARN GUIDE ROLLER ELBOW

FIELD OF THE INVENTION

The present invention relates to yarn guides, and, more particularly, to an adjustable yarn guide elbow including a bearing roller.

BACKGROUND OF THE INVENTION

In the handling of yarns and filaments, such as in texturizing processes, it is necessary to guide, direct, and redirect the yarn or filament. Guide means must be provided to support and guide the yarn through the process. Contact between the yarn and each guide results in friction between them, which in turn causes a drag on the traveling yarn. Each guide, and hence contact point, along the path of the yarn increases the tension on the yarn beyond that point. Guides in series have a cumulative effect on the tension induced in the yarn. Because of the limited strength of many yarns and filaments, the number and magnitude of contacts in a process may limit the number of operations and speed of processing which may be used. Moreover, the increased tension in the yarn or filament increases the yarn breakage rate of the process and, in the case of some yarns and filaments such as fine denier nylon, polypropylene, solution-dyed yarns, and especially micro denier yarns, a process may be altogether impractical as a result of an unacceptable breakage rate.

In certain processes, including yarn texturizing processes, it is known to transport the yarn through tubes so as to better control the environment of the yarn and quickly and conveniently thread the yarn through the processing equipment. Where two adjacent tubes are disposed at an angle to one another, it is necessary to provide an elbow connector to join the ends of the tubes. Conventionally, a length of tubing is formed as a curved conduit, the inner surface thereof providing a concave guide surface for the yarn in negotiating the turn. It will be appreciated that such provision results in inordinate friction between the guide surface and the yarn, particularly because the yarn is being urged, at least to some degree, into contact with the surface.

As an alternative to the curved, static surface guide elbow discussed above, guide elbows have been employed which include a bearing roller. In conventional fashion, a rigid length of bent tubing or a housing having a conduit formed therein is provided. Within the tube or housing is disposed a freely rotatable roller having a groove formed therein for receiving the yarn. The roller is disposed at the apex of the turn, the axis of its rotation being perpendicular to the plane defined by the turn.

While providing certain benefits such as reduced drag on the yarn, guide elbows equipped with rollers as described above have certain drawbacks. Because the elbows are fixed in position, for a given juncture it is necessary to use an elbow preformed to a certain angle or modify the system to accommodate the angle dictated by the elbow. Guide elbows of the prior art have been formed of transparent material, however, the entire housing is formed from the material providing a weaker housing than may be desired. Even if the roller is visible from exteriorly of the elbow, the guide elbows of the prior art do not provide a means for easily determining whether the roller is spinning freely. Moreover, the guide elbows of the prior art do not provide a convenient means for replacing the guide elbow.

Thus, there exists a need for a guide elbow having a bearing roller which may be selectively adjusted for use in joining adjacent tubes disposed at a range of angles with respect to one another. There exists a need for such an adjustable guide elbow which may be secured at a given angle and re-adjusted when desired. Moreover, there exists a need for such an adjustable guide elbow which provides an easy and convenient means for detecting whether the roller is spinning properly. There exists a need for such a guide elbow which provides for convenient removal and replacement of the roller.

SUMMARY OF THE INVENTION

The present invention is directed to a yarn guide elbow for directing a yarn or filament in a textile process, such as a texturing process. The yarn guide elbow of the present invention includes a housing, the housing defining a cavity and first and second members. The first member has a first opening formed therein and the second member has a second opening formed therein. Each of the first and second openings are formed so as to communicate with the cavity. A roller is disposed within the cavity and mounted on the housing for rotation. The roller is rotatable about an axis such that each of the first and second openings are disposed substantially adjacent the periphery of the roller. The first and second members are relatively adjustable such that the distance between the first and second openings may be selectively adjusted. The cavity fluidly connects the first and second openings.

In a preferred embodiment, the housing of the yarn guide elbow includes a first casing and a second casing. At least one first opening is formed in the first casing and at least one second opening is formed in the second casing. The distance between the first and second openings may be selectively adjusted by rotating the first and second casings with respect to one another. Preferably, at least one of the first and second casings is mounted on the housing so as to rotate about the axis of the roller.

The above-described preferred embodiment may be configured such that the first and second casings are concentrically arranged with at least a portion of the second casing disposed within the first casing. A first slot is formed in the first casing and a second slot is formed in the second casing. The first opening and the second slot are relatively disposed so as to remain in communication when the distance between the first and second openings is selectively adjusted as described above. Likewise, the second opening and the first slot are relatively disposed so as to remain in communication when the distance between the first and second openings is selectively adjusted as described above.

Preferably, means are provided for securing the positions of the first and second openings relative to one another.

Preferably, the housing further includes a window arranged and configured such that the roller may be viewed from exteriorly of the housing, thereby allowing the operator to determine whether the roller is spinning properly. In addition, the roller preferably includes a mark thereon, the mark positioned so as to be viewed through the aforementioned window, thereby further aiding the operator in determining whether the roller is spinning properly.

A tube may be provided extending from one or both of the first and second openings.

DETAILED DESCRIPTION OF THE PREFERRED EMBODIMENT

Figure 1:
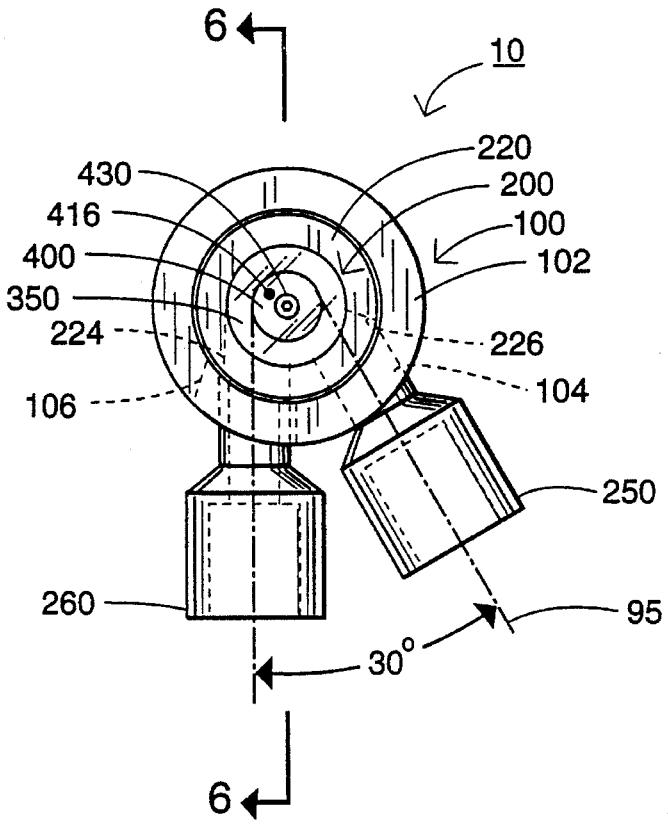
FIG. 1 a front elevational view of the yarn guide elbow of the present invention shown adjusted for a first angle.

With reference to FIGS. 1–6, an adjustable yarn guide roller elbow according to the present invention, generally denoted 10, is shown therein. Elbow 10 includes first or outer casing 100 and second or inner casing 200 which together form a housing for roller 400. Outer casing 100 includes threaded bore 104 for securing tube 250 therein and slot 106 for slidably receiving a portion of tube 260. Similarly, inner casing 200 includes threaded bore 224 for securing tube 260 and slot 226 for slidably receiving a portion of tube 250. In use, yarn 95 extends through tube 260, slot 106, and bore 224, over roller 400, and through slot 226, bore 104, and tube 250.

Roller 400 is secured for rotational movement between inner support cap 300 and outer support cap 350. Outer support cap 350 is preferably transparent or translucent, thereby forming a window so that roller 400 may be viewed from exteriorly of elbow 10. Furthermore, contrasting mark 416 is imprinted or formed on roller 400 to enable the operator to more easily determine whether roller 400 is rotating freely.

Figure 5:
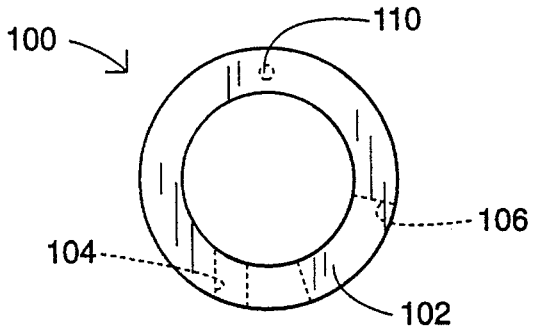
FIG. 5 is a front elevational view of the outer casing of the yarn guide elbow of the present invention.

Outer casing 100, as best seen in FIG. 5, comprises ring member 102. Ring member 102 is preferably formed from aluminum or plastic by machining or molding. Ring member 102 has threaded bore 104 and slot 106 formed therein. Bore 104 extends through ring member 102 and is sized to receive and secure the threaded end of tube 250. Slot 106 likewise extends through ring member 102 and has a length extending circumferentially about ring member 102 which is greater than the diameter of tube 260 so that tube 260 may be moved through and about ring member 102. Bore 110 is formed in ring member 102 for receiving adjustment screw 440, as discussed below.

Figure 4:
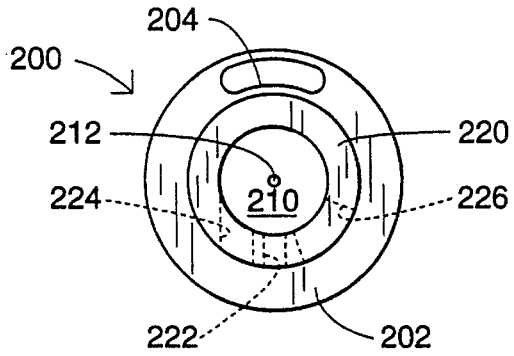
FIG. 4 is a front elevational view of the inner casing of the yarn guide elbow according to the present invention.

Inner casing 200, as best seen in FIG. 4, includes peripheral wall 202, annular wall 220 extending upwardly from peripheral wall 202, and interior wall 210 defined within annular wall 220. Inner casing 200 is preferably formed as an integral unit from aluminum or plastic by machining or molding. When elbow 10 is assembled as discussed below, annular wall 220 is sized such that its outer periphery may be slidably received within the inner circumference of ring member 102. Annular wall 220 defines a cavity 90 within elbow 10. Peripheral wall 202 preferably extends to the outer circumference of ring member 102. Annular wall 220 includes threaded bore 222 formed therein for receiving interference screw 450, threaded bore 224 for receiving tube 260, and slot 226 for receiving a portion of tube 250. Bore 224 is sized to receive and secure the threaded end of tube 260. Slot 226 has a length extending circumferentially about annular wall 220 which is greater than the diameter of tube 250 so that the tube may be slidably moved through and about annular wall 220. Longitudinal, arcuate slot 204 is formed in peripheral wall 202 for receiving adjustment screw 440, as discussed below.

Inner support cap 300 includes side wall 310 sized to fit securely within annular wall 220, the back wall of inner support cap 300 abutting interior wall 210. Tapered wall 306 extends from side wall 310 to outer annular flange 302. Outer annular flange 302 defines seat 312. Inner annular flange 304 projects from seat 312 and defines aperture 314. Aperture 314 extends through inner support cap 300 and is sized to receive axial screw 430. Inner annular flange 304 is sized to interface or mate with the end of spindle tube 414 of roller 400. Seat 312, outer annular flange 302, and inner annular flange 304 are sized and configured such that outer annular flange 302 overhangs the inner peripheral lip 406 of roller 400, as discussed below. Inner support cap 300 may be formed from any suitable material such as, for example, acrylic, plastic, aluminum, or metal by machining or molding.

Roller 400 includes carrier ring 402 mounted on mount ring 412. Spindle tube 414 extends through mount ring 412 and is mounted such that mount ring 412, and thus carrier ring 402, may spin freely with respect to spindle tube 414. Rotation of mount ring 412 about spindle 414 may be facilitated by bearings (not shown), for example. Carrier ring 402 includes peripheral lips 406 which define groove 410. Mark 416 is provided on the outer surface of carrier ring 402. Mark 416 may be, by way of example, ink or paint. Groove 410 is adapted to receive and guide yarn 95. Roller 400 may be any suitable bearing roller, such as, for example, a ceramic, plastic, or metal pulley with a high speed bearing. Carrier ring 402 may be formed of any suitable material such as, for example, ceramic, plastic, or metal.

Outer support cap 350 is essentially the same as inner support cap 300. Outer support cap 350 includes outer annular flange 352, inner annular flange 354, tapered wall 356, side wall 360, seat 362, and aperture 364. Outer support cap 350 is preferably formed from a transparent material such as acrylic by machining or molding.

Tubes 250, 260 may be formed from any suitable material such as, for example, plastic or aluminum. Tubes 250 and 260 are preferably provided with O-rings 252 and 262, respectively, for forming an air-tight seal with an inserted tube of appropriate diameter.

Figure 3:
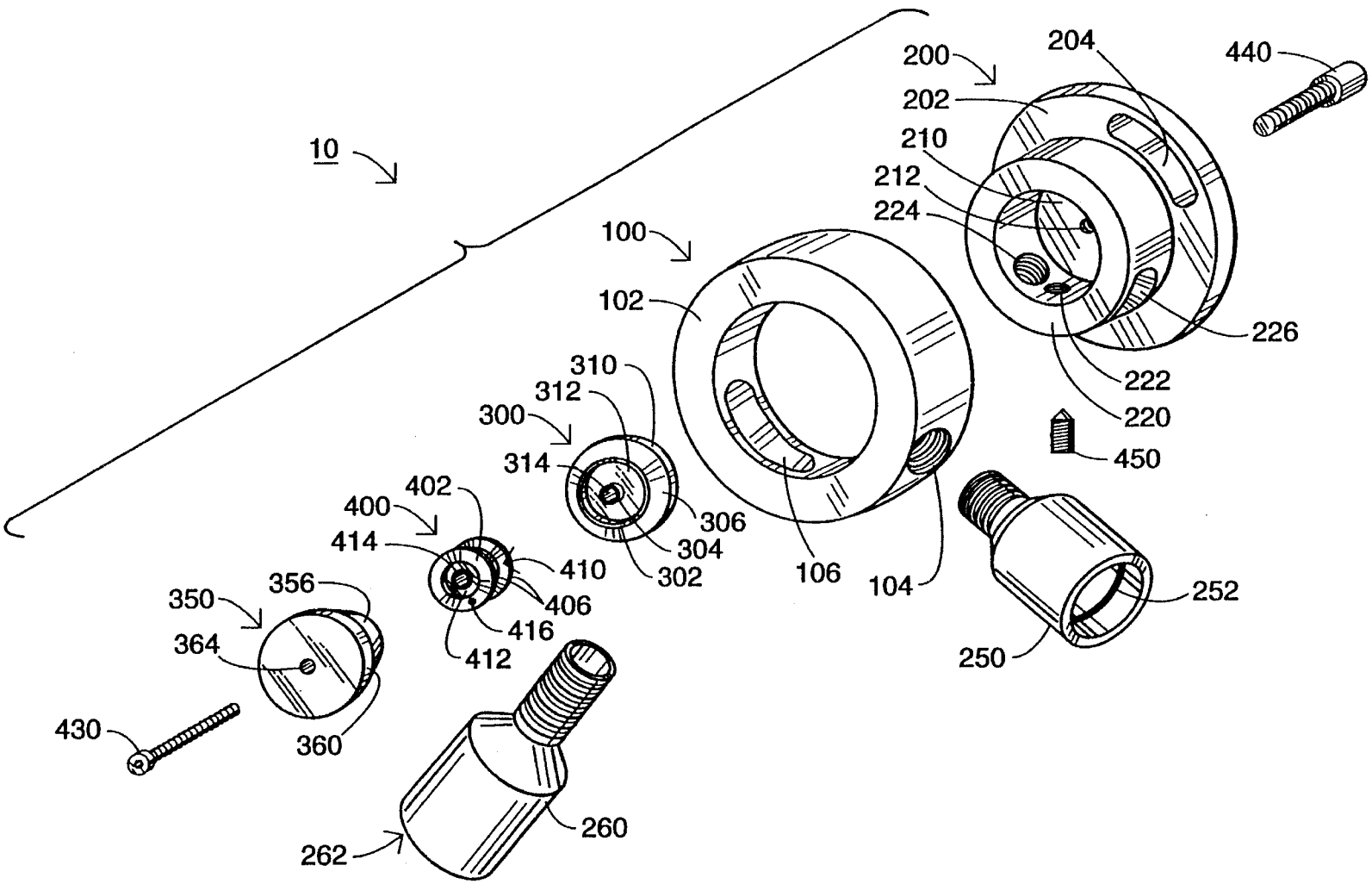
FIG. 3 is an exploded perspective view of a yarn guide elbow according to the present invention.
Figure 6:
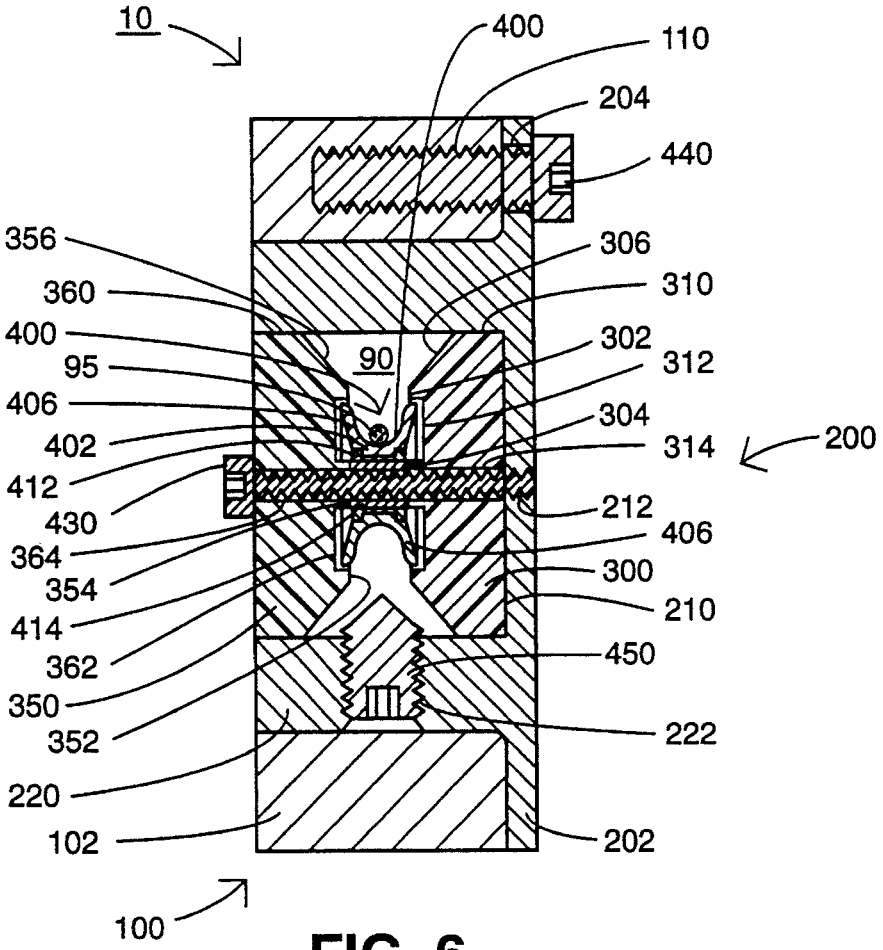
FIG. 6 is a side cross-sectional view of the yam guide elbow of the present invention taken along the line 6—6 of FIG. 1, the first and second tubes removed for clarity.

The assembly of elbow 10 may be best understood with reference to FIGS. 3 and 6. Inner support cap 300 is inserted into annular wall 220 of inner casing 200 such that it abuts against inner wall 210. Roller 400 is mounted on inner support cap 300 such that outer annular flange 302 hangs over the inner peripheral lip 406 and the facing surface of inner annular flange 304 abuts the end surface of spindle tube 414. Interference screw 450 is screwed into bore 222 such that it does not extend beyond the outer periphery of annular wall 220. Ring member 102 is placed over and about annular wall 220 such that it abuts against peripheral wall 202 and bore 110 is aligned with slot 204. Outer support cap 350 is inserted into ring member 102 such that outer annular flange 302 surrounds and overhangs the outer peripheral lip 406 of roller 400 and inner annular flange 354 abuts the end of spindle tube 414. Adjustment screw 440 is inserted through slot 204 and engaged with threaded bore 110 of outer casing 100. Axial screw 430 is inserted through aperture 364, spindle tube 440, aperture 314, and engaged with threaded bore 212 of inner casing 200. Tube 250 is screwed into threaded bore 104 of outer casing 100. Tube 260 is inserted through slot 106 of outer casing 100 and screwed into threaded bore 224 of inner casing 200.

Once elbow 10 has been assembled as described above, spindle robe 414 is securely held between inner flanges 304 and 354. Mount ring 412 and carrier ring 402 are partially disposed within seats 312 and 362 with clearance provided between peripheral lips 406 and outer annular flanges 302, 352 so that roller 400 may spin freely about spindle tube 414.

Figure 2:
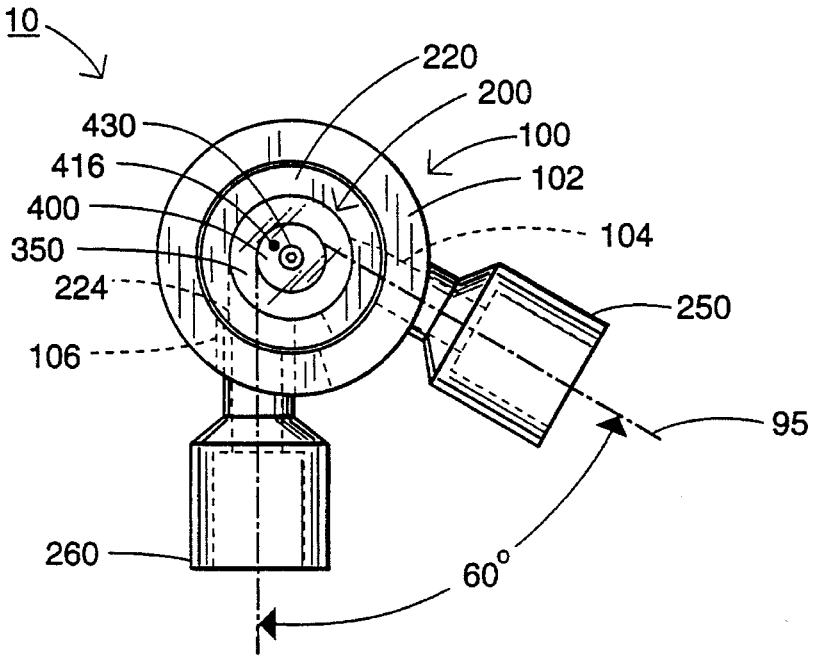
FIG. 2 is a front elevational view of the yarn guide elbow of the present invention shown adjusted for a second angle.

With reference to FIGS. 1 and 2, the angle between tube 260 and tube 250 may be adjusted by rotating outer casing 100 with respect to inner casing 200 about axial screw 430. As the casings are rotated with respect to one another, tube 260 which is fixedly mounted to inner casing 200 will slide along the length of slot 106. Tube 250 is secured in threaded bore 104 of outer casing 100 and opens into slot 226 of inner casing 200. As the inner and outer casings are rotated with respect to one another, tube 250 will open into different portions along the length of slot 226. In this way, an unobstructed path is maintained for yarn 95 from the terminal opening of tube 250 to roller 400 for the entire range of adjustment.

Once an angular adjustment has been made, adjustment screw 440 may be tightened into threaded bore 110 to provide interference between ring member 102 and peripheral wall 202, thereby securing the angular adjustment.

Elbows 10 as described above may be formed so as to be substantially airtight. In this way, a yarn 95 may be threaded through elbow 10 by placing the yarn end at the opening of tube 260 (or an associated length of tubing) and applying suction at the opening of tube 250 (or an associated length of tubing). The yarn is drawn through tube 260, over roller 400, and through tube 250. Interference screw 450 helps to insure that the yarn end travels over the roller rather than directly from tube to tube. Interference screw 450 blocks a portion of the air path between the tube openings thereby creating a selected degree of turbulent flow and reducing the area of the flow path. Interference screw 450 thereby reduces the velocity of air flowing under the roller relative to the velocity of air travelling over the roller. As a result, the pressure drop due to the suction is greater over the roller than under the roller and the yarn end tends to take the desired path over the roller. Because tapered walls 306, 356 of inner and outer support caps 300, 350 overhang and surround peripheral lips 406 of roller 400, the yarn will tend to seat in groove 410 once tension is applied to the yarn.

Because outer support cap 350 is transparent or translucent, roller 400 may be viewed from exteriorly of elbow 10. Moreover, mark 416 allows for quick inspection of the operation of roller 400.

Roller 400 may be quickly and conveniently replaced by removing axial screw 430 and outer support cap 350.

It will be appreciate that while an elbow 10 adjustable through a range of about 30° (FIG. 1) to about 60° (FIG. 2) has been illustrated, any range of adjustment may be provided by reconfiguring the lengths and/or locations of the slots 106, 226, and/or the locations of bore holes 104, 224.

Because outer support cap 350 and the inner and outer casings are separately formed, the outer support caps may be formed from a transparent material such as plastic, without requiring that the casings be formed from the same material. Thus, inner casing 200 and outer casing 100 may be formed from metal or the like so as to provide a desired degree of integrity.

Figure 7:
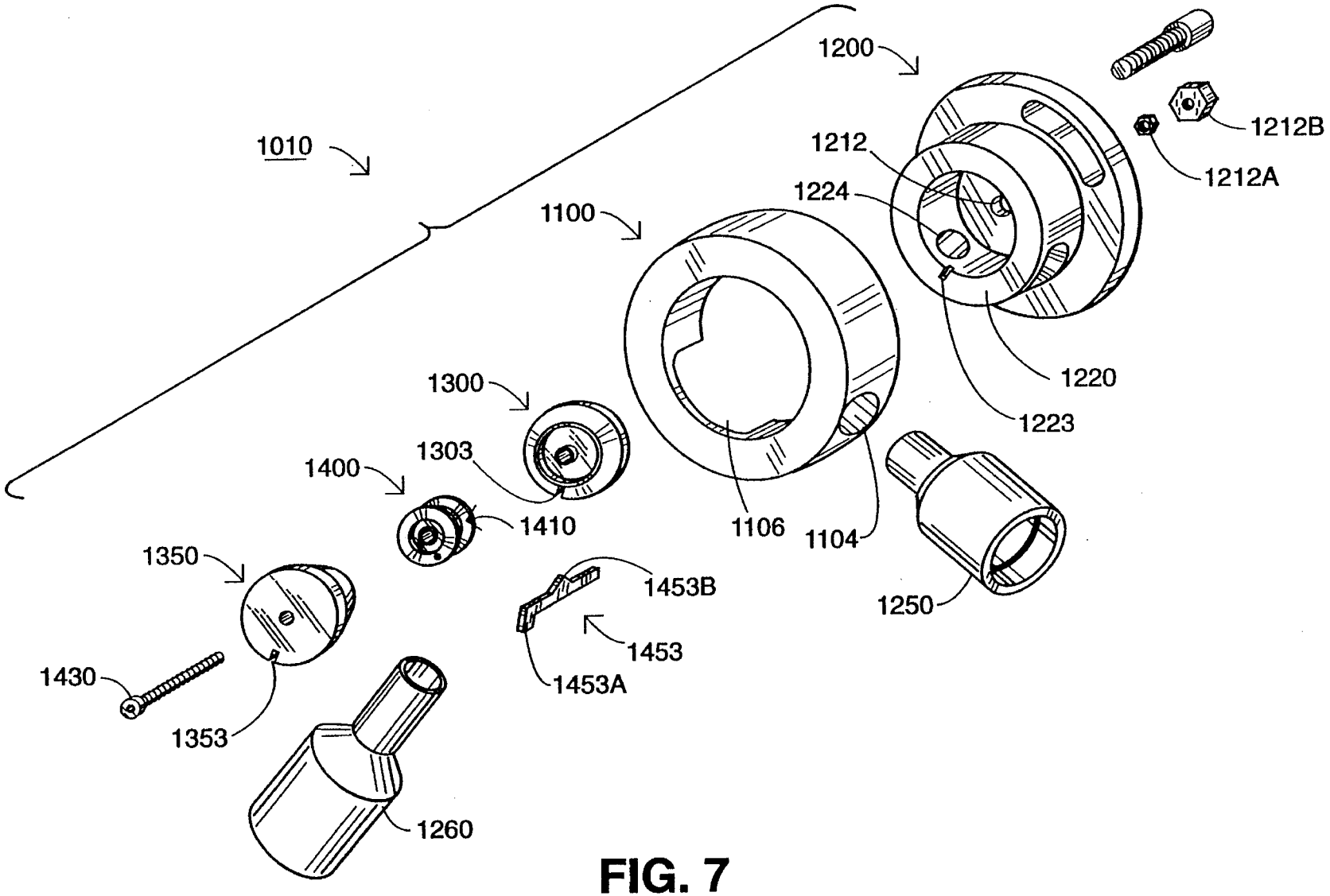
FIG. 7 is an exploded perspective view of a yarn guide elbow according to a second embodiment of the present invention.

With reference to FIG. 7, a yarn guide roller elbow 1010 according to a second embodiment is shown therein. Elbow 1010 is adapted for ease of assembly and disassembly as well as improved control of the yarn end. Yarn guide roller elbow 1010 is substantially the same as yarn guide roller elbow 10 of the first embodiment, except for the following modifications.

Interference screw 450 of elbow 10 is replaced with blocker 1453. Blocker 1453 is preferably formed from metal such as stainless steel. Blocker 1453 could be formed from plastic as well. Blocker 1453 has upwardly extending projection 1453B which, when elbow 1010 is assembled, is partially disposed within and spaced from the bottom of groove 1410. In this way, blocker 1453 serves the same function as interference screw 450, that is, it reduces the pressure drop under the roller relative to the pressure drop over the roller so that the yarn end under suction tends to travel over the roller. Blocker 1453 seats in channels 1303 and 1353 formed in inner support cap 1300 and outer support cap 1350, respectively. Tab 1453A seats in notch 1223 formed in annular wall 1220. No thread bore corresponding to threaded bore 222 of elbow 10 is required.

Assembly and disassembly of elbow 1010, especially for the purposes of cleaning the roller, are facilitated by the provision or blocker 1453, channels 1303 and 1353, nut 1212A, nut 1212B, and enlarged bore 1212. More particularly, nut 1212A is adapted to engage screw 1430 and thereby hold support caps 1300, 1350 and roller 1400 together in proper relationship. Bore 1212, preferably not threaded, is sized to provide clearance for nut 1212A. Nut 1212B, also adapted to engage screw 1430, is of greater diameter than bore 1212, thereby serving to hold support caps 1300 and 1350, roller 1400, and screw 1430 in place when elbow 1010 is assembled. Proper positioning of the components is insured by notch 1223 in which tab 1453A seats.

In service, the support caps, roller, and blocker may be removed as an intact unit by removing nut 1212B, whereupon the aforesaid components may be withdrawn through annular wall 1220 and blocker 1453 may be removed from channels 1303, 1353. It will be appreciated that because nut 1212B is still mounted on screw 1430, the support caps and roller will remain as a unit. The roller may be cleaned or cleared of a jam and reinstalled in the casings 1100, 1200. If desired, elbow 1010 may be further disassembled by removing nut 1212A.

Yarn guide roller elbow 1010 also differs from yarn guide roller elbow 10 in that threads corresponding to the threads of bores 104, 224, and tubes 250, 260 are not present. To facilitate manufacture, tubes 1250 and 1260 are instead secured within bores 1104 and 1224, respectively, by press fitting and gluing with LOCTITE® or other suitable securing material.

To further aid in assembly and disassembly of elbow 1010, casing 1100 is provided with C-shaped cut out 1106 rather than a slot corresponding to slot 106 of elbow 10 according to the first embodiment. It will be appreciated that the provision of cut out 1106 allows casings 1100 and 1200 to be mated before or after tube 1260 has been secured in bore 1224, as desired.

While a preferred embodiment of the present invention has been described, it will be appreciated by those of skill in the art that certain modifications may be made without departing from the scope of the present invention. All such modifications are intended to come within the scope of the claims which follow.

What is claimed is:

1. A yarn guide elbow for directing a yarn or filament, said yarn guide elbow comprising:

a) a housing, said housing forming an enclosed cavity and having first and second members, said first member having a first opening formed therein and said second member having a second opening formed therein, each of said first and second openings communicating with said cavity;

b) a roller disposed within said cavity of said housing and defining a periphery adapted to receive the yarn, said roller mounted in said housing for rotation about an axis such that each of said first and second openings are disposed substantially adjacent said periphery;

c) said first and second members being relatively adjustable such that the distance between said first and second openings may be selectively adjusted; and d) wherein said cavity fluidly connects said first and second openings.

2. The yarn guide elbow of claim 1 wherein said housing further includes a window arranged and configured such that said roller may be viewed from exteriorly of said housing.

3. The yarn guide elbow of claim 2 wherein said roller includes a mark thereon, said mark positioned so as to be viewed through said window.

4. The yarn guide elbow of claim 1 wherein said first member includes a first casing and said second member includes a second casing, said first and second casings rotatably joined by a connector, said first opening formed in said first casing mad said second opening formed in said second casing, and wherein the distance between said first and second openings may be selectively adjusted by rotating said first casing with respect to said second casing.

5. The yarn guide elbow of claim 4 wherein at least one of said first and second casings is rotatable about said axis.

6. The yarn guide elbow of claim 1 further including means for securing the positions of said first and second openings relative to one another.

7. The yarn guide elbow of claim 1 further including a tube extending from at least one of said first opening and said second opening.

8. The yarn guide elbow of claim 1 further including interference means disposed within said cavity between said first and second openings and operative to interfere with the flow of air through a portion of said cavity and between said first and second openings.

9. A yarn guide elbow for directing a yarn or filament, said yarn guide elbow comprising:

a) a housing, said housing defining an enclosed cavity and comprising:

i) a first casing, said first casing having at least one first opening formed therein, said at least one first opening communicating with said cavity, ii) a second casing, said second casing having at least one second opening formed therein, said at least one second opening communicating with said cavity;

b) a roller disposed within said housing and defining a periphery, said roller mounted in said housing for rotation about an axis such that each of said first and second openings are disposed substantially adjacent said periphery:

c) said first and second casings being attached for relative rotation about said axis whereby the distance between said first and second openings may be selectively adjusted; and d) wherein said cavity fluidly connects said first and second openings.

10. The yarn guide elbow of claim 9 wherein said housing further includes a window arranged and configured such that said roller may be viewed from exteriorly of said housing.

11. The yarn guide elbow of claim 10 wherein said roller includes a mark thereon, said mark positioned so as to be viewed through said window.

12. The yarn guide elbow of claim 9 further including means for securing the position of said first and second openings relative to one another.

13. The yarn guide elbow of claim 9 further including a tube extending from at least one of said first opening and said second opening.

14. The yarn guide elbow of claim 9 further including interference means disposed within said cavity between said first and second openings and operative to interfere with the flow of air through a portion of said cavity and between said first and second openings.

15. A yarn guide elbow for directing a yarn or filament, said yarn guide elbow comprising:

a) a housing, said housing defining an enclosed cavity and comprising:

i) a first casing, said first casing having at least one first opening formed therein, said at least one first opening communicating with said cavity, ii) a second casing said second casing having at least one second opening formed therein said at least one second opening communicating with said cavity;

b) a roller disposed within said housing and defining a periphery, said roller mounted in said housing for rotation about an axis such that each of said first and second openings are disposed substantially adjacent said periphery;

c) said first and second casings being attached for relative rotation about said axis whereby the distance between said first and second openings may be selectively adjusted: and d) interference means disposed within said cavity between said first and second openings and extending from said housing towards said roller, said interference means operative to interfere with the flow of air through a portion of said cavity between said first and second openings.

16. A yarn guide elbow for directing a yarn or filament, said yarn guide elbow comprising:

a) a housing defining an enclosed cavity;

b) a roller rotatably mounted within said housing and adapted to receive the yarn;

c) said housing defining a window opening adjacent said roller and including a window member disposed in said window opening, said window member formed of a non-opaque material so that said roller may be viewed from exteriorly of said housing; and d) wherein said roller includes a mark thereon, said mark positioned so as to be viewed through said window member.

17. A yarn guide elbow for directing a yarn or filament, said yarn guide elbow comprising:

a) a housing, said housing forming an enclosed cavity and having first and second members, said first member having a first opening formed therein and said second member having a second opening formed therein, each of said first and second openings communicating with said cavity;

b) a roller disposed within said cavity of said housing and defining a periphery adapted to receive the yarn, said roller mounted in said housing for rotation about an axis such that each of said first and second openings are disposed substantially adjacent said periphery;

c) said first and second members being relatively adjustable such that the distance between said first and second openings may be selectively adjusted; and d) a tube extending from at least one of said first opening and said second opening.

18. A yarn guide elbow for directing a yarn or filament, said yarn guide elbow comprising:

a) a housing, said housing defining an enclosed cavity and comprising:

i) a first casing, said first casing having at least one first opening formed therein, said at least one first opening communicating with said cavity, ii) a second casing, said second casing having at least one second opening formed therein, said at least one second opening communicating with said cavity;

b) a roller disposed within said housing and defining a periphery, said roller mounted in said housing for rotation about an axis such that each of said first and second openings are disposed substantially adjacent said periphery;

c) said first and second casings being attached for relative rotation about said axis whereby the distance between said first and second openings may be selectively adjusted; and d) a tube extending from at least one of said first opening and second opening.

19. A yarn guide elbow for directing a yarn or filament, said yarn guide elbow comprising:

a) a housing, said housing forming an enclosed cavity and having first and second members, said first member having a first opening formed therein and said second member having a second opening formed therein, each of said first and second openings communicating with said cavity:

b) a roller disposed within said cavity of said housing and defining a periphery adapted to receive the yarn, said roller mounted in said housing for rotation about an axis such that each of said first and second openings are disposed substantially adjacent said periphery;

c) said first and second members being relatively adjustable such that the distance between said first and second openings may be selectively adjusted; and d) said housing further including a window opening adjacent said roller and a window member disposed in said window opening, said window member formed of a non-opaque material such that said roller may be viewed from exteriorly of said housing.

20. The yarn guide elbow of claim 19 wherein said roller includes a mark thereon, said mark positioned so as to be viewed through said window member.

21. A yarn guide for directing a yarn or filament, said yarn guide elbow comprising:

a) a housing, said housing defining an enclosed cavity and comprising:

i) a first casing, said first casing having at least one first opening formed therein, said at least one first opening communicating with said cavity, ii) a second casing, said second casing having at least one second opening formed therein, said at least one second opening communicating with said cavity;

b) a roller disposed within said housing and defining a periphery, said roller mounted in said housing for rotation about an axis such that each of said first and second openings are disposed substantially adjacent said periphery;

c) said first and second casings being attached for relative rotation about said axis whereby the distance between said first and second openings may be selectively adjusted; and d) said housing further including a window opening adjacent said roller and a window member disposed in said window opening, said window member formed of a non-opaque material such that said roller may be viewed from exteriorly of said housing.

22. The yarn guide elbow of claim 21 wherein said roller includes a mark thereon, said mark positioned so as to be viewed through said window member.

23. A yarn guide elbow for directing a yarn or filament, said yarn guide elbow comprising:

a) a housing, said housing forming an enclosed cavity and having first and second members, said first member having a first opening formed therein and said second member having a second opening formed therein, each of said first and second openings communicating with said cavity;

b) a roller disposed within said cavity of said housing and defining a periphery adapted to receive the yarn, said roller mounted in said housing for rotation about an axis such that each of said first and second openings are disposed substantially adjacent said periphery;

c) said first and second members being relatively adjustable such that the distance between said first and second openings may be selectively adjusted; and d) interference means disposed within said cavity between said first and second openings and extending from said housing towards said roller, said interference means operative to interfere with the flow of air through a portion of said cavity between said first and second openings.

* * * * *